United States Patent [19]

Taylor

[11] 4,169,598

[45] Oct. 2, 1979

[54] DOUBLE PURPOSE GOAL STRUCTURE

[76] Inventor: Lawrence H. Taylor, P.O. Box 49-58, 48th St.,, Union City, N.J. 07087

[21] Appl. No.: 693,747

[22] Filed: Jun. 8, 1976

[51] Int. Cl.[2] ..... A63B 71/02

[52] U.S. Cl. ..... 273/127 B; 273/105 R

[58] Field of Search ..... 273/26 A, 127 R, 127 B, 273/1 B, 1 D, 95 R, 95 H, 102.4, 105 R

[56] References Cited

U.S. PATENT DOCUMENTS

| | | | |
|---|---|---|---|
| 2,583,493 | 1/1952 | Prentice et al. | 273/127 B |
| 3,979,120 | 9/1976 | Dietrich | 273/127 B |

*Primary Examiner*—Richard C. Pinkham
*Assistant Examiner*—T. Brown

[57] ABSTRACT

The double purpose goal structure makes possible two different types of scoring during a game like soccer, rugby, English football, or the like when a more conventional score may be made by the act of driving the ball into a lower netted "cage" section or through upper "field goal" frame when the ball may be kicked or otherwise driven for this goal over the heads of most intervening players from midfield points that would be less likely to be achieved if directed only toward the lower "cage" goal part of the double purpose goal structure.

The double purpose goal structure includes a pair of spaced apart vertical post elements having attached thereto a screened framework positioned therebetween and extending rearward thereof to define a ball-trapping first goal opening. The post elements are of a height to extend a predetermined distance above the first goal opening.

A crossbar is extended between and attached to the post elements at a predetermined height above and in the same plane of the mouth of the first goal opening to define a second goal opening; the second goal permitting a ball to pass freely therethrough. Thus the dual purpose goal structure provides two alternate options for scoring in a single goal structure.

1 Claim, 1 Drawing Figure

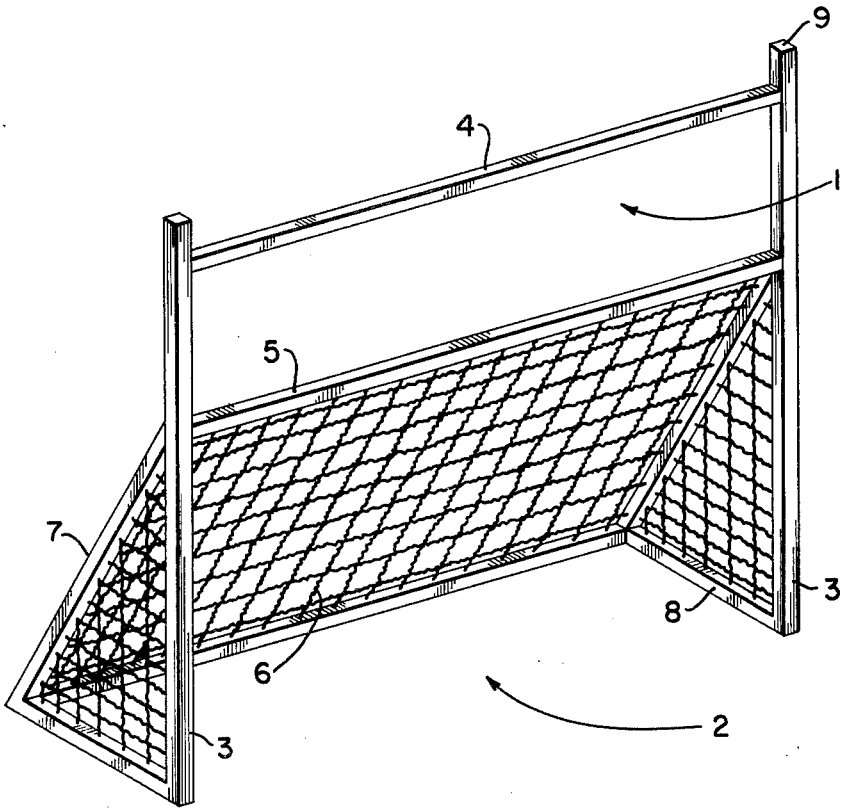
9
4
1
5
7
3
8
6
2
3

DOUBLE PURPOSE GOAL STRUCTURE

SUMMARY OF THE INVENTION

A Double Purpose Goal Structure having a netted cage area at the base and a wide and open framed area at the top, has been invented to make a substantial improvement in soccer specifically and other kicking ball games by giving the players on the field in play, two concurrent options for scoring during play by either kicking the ball into the lower netted cage goal for the highest goal score, or alternately kicking the ball thru the upper open field goal frame for a lesser goal score. The cage goal is worth more score points, but harder to make because of better defense capability while the field goal is less valuable score wise but easier to make because it can be kicked over the heads of the defense, if the kicker has the skill, and is not blocked in his kick. The fact that both scoring plays are always open options, means that the offense defense will be faster and play a more open game, as scoring can occur from a considerable distance from the goal, so every player with the ball must be rushed as quickly as possible to prevent scoring from mid-field, and yet the home goal post must be covered too lest a cage goal be made if left improperly defended. The game is much faster and brainier and hence makes a better contest and exhibition of sports team-skill. The kicking of field goals adds display and suspense like the forward pass in football and the home run in baseball, making the game of court soccer that uses these new double purpose goal posts the fastest and brainiest display sport in the world.

To sports enthusiast the rules of a game may seem inviolate, yet those who chronicle the development of a sport, relate a pattern of change some times slow and sometimes dramatic.

Soccer, as an outdoor game has been played on a large field for many decades, almost world wide, with large popular following, but it has failed to achieve the same degree of popularity in some countries, like the U.S. and others, accustomed to a different type of sports exhibition fare.

The game has been moved indoors, though not necessarily, to smaller field areas like hockey rinks, where better spectator viewing and comfort in bad weather is possible, but this has failed to bring the popularity that the outdoor game enjoys in other countries.

To create a more interesting spectator sport, therefore, certain new equipment, a double purpose goal structure, has been invented by me for use in a new type of soccer game called "Court Soccer" which uses this new equipment in the game play.

This new equipment is a goal structure designed to permit the making of two different types of goals in the course of play. The similar goal structures placed at each end of the playing field have a closed base cage area, see specification, and an open top framed score area, see specification.

The players can kick "cage" goals into the bottom netted cage area which will keep the ball from passing thru the base cage section, while the top field goal aperture will allow the ball to be kicked completely thru it from any point on the field. The ball does not go out of play when it goes thru the field goal frame but continues in full action different from a "cage" goal which necessitates a new kick off as in conventional soccer.

The double purpose goal structure will permit and encourage a more interesting sport display of competing "Court Soccer" or other teams playing "Ball", using these new goal structures to create a wholly new game technique in which the players, by strategy, are more dispersed in play to prevent the easy placement of "field goals" kicked from a distance, yet they, in tactics, try at the same time to play close enough to the goal to make an attempt for the higher scores of "cage" goals vs. "field goals."

BRIEF DESCRIPTION OF THE DRAWINGS

The FIGURE is a perspective view of the double purpose goal structure.

DETAILED DESCRIPTION

The drawing shows an aperture called the Field Goal frame at the top of the structure useable for kick-thru scoring from the playing field over the heads of goalie and defending players and further providing a lower caged goal area for a different and likely higher goal score due to the relative greater difficulty of such scoring past defending players, which allows attacking players an option of 2 different scoring means requiring defending players to continuously maintain two types of defensive play making the game thereby, much faster more strenuous and placing a higher premium on smarter and better trained players than imposed by single purpose goal structures.

The Field Goal Frame is comprised of crossbars 4 on the top and 5 on the bottom and by part of vertical posts 3 on each side, located at the top of the goal structure, through which goals may be scored when the soccer ball is kicked through this Field Goal Frame. At the base of the goal structure is the cage goal area as indicated by 2, which is enclosed on the back and the two adjourning sides by netting 6, to contain the ball when kicked into this second goal area for score.

The base cage goal area is formed by part of the vertical posts 3 on each side as shown and by the cross bar 5 on the top as shown. The vertical post braces 7 and base connectors 8 provide framing means for the side netting 6 and braces for the vertical goal posts 3. The extensions 9 above the frame area are not functional, except hold team flags and dress the structure to conform better visually to popular concepts of goal posts such as in football or rugby.

I claim:

1. A dual purpose goal structure to be used with its widest dimension facing the field of play comprised of a pair of vertical side posts with a lateral crossbar interconnecting said side posts to form the top of a caged area suitably equipped with netting to prevent the pass-through of a game ball that might be driven into this netted lower cage area for score, and with said crossbar also serving as the bottom member of a further, but different ball pass-through scoring area above the said lower cage area, circumscribed by the said cross bar forming the top of the lower cage area on the bottom, and the said vertical side posts on the sides, and a further lateral crossbar on the top of the ball pass-through scoring area interconnecting the said side posts, with such upper ball pass-through scoring area not being provided with a netted retaining structure, as in the lower area, so as in the second case, to freely permit the pass-through of a game ball for score, thus providing players, of substantially a kick ball game, with two alternate optional scoring means in a single goal structure, particularly adapted to such alternate playing and scoring use.

* * * * *